US006405503B1

(12) United States Patent
Reed

(10) Patent No.: US 6,405,503 B1
(45) Date of Patent: Jun. 18, 2002

(54) DECORATIVE CORNER TRIM AND MOUNTING SYSTEM FOR SHEET SIDING USED ON WOOD AND STEEL FRAME STRUCTURES

(76) Inventor: Ronnie E. Reed, 252 N. 900 East, Payson, UT (US) 84651

( * ) Notice: Subject to any disclaimer, the term of this patent is extended or adjusted under 35 U.S.C. 154(b) by 0 days.

(21) Appl. No.: 09/604,625

(22) Filed: Jun. 27, 2000

(51) Int. Cl.[7] ..... E04F 13/00
(52) U.S. Cl. ..... 52/288.1; 52/312
(58) Field of Search ..... 52/288.1, 287.1, 52/312, 554, 717.04, 717.05, 718.04

(56) References Cited

U.S. PATENT DOCUMENTS

| | | | | | |
|---|---|---|---|---|---|
| 3,286,422 | A | * | 11/1966 | Pangerl | 52/288.1 X |
| 3,651,610 | A | * | 3/1972 | Donahue | 52/523 X |
| 4,189,885 | A | * | 2/1980 | Fritz | 52/288.1 X |
| 4,319,439 | A | * | 3/1982 | Gussow | 52/288.1 X |
| 5,694,726 | A | * | 12/1997 | Wu | 52/287.1 |
| 5,694,728 | A | * | 12/1997 | Heath et al. | 52/554 |
| 5,787,661 | A | * | 8/1998 | Sharp | 52/554 X |
| 5,802,790 | A | * | 9/1998 | Lamont et al. | 52/288.1 |
| 5,836,123 | A | * | 11/1998 | Gulino | 52/288.1 |
| 5,850,717 | A | * | 12/1998 | Schiedegger et al. | 52/288.1 |
| 5,974,748 | A | * | 11/1999 | Sciuga et al. | 52/287.1 |
| 6,125,605 | A | * | 10/2000 | Young | 52/288.1 X |

* cited by examiner

*Primary Examiner*—David M. Purol
(74) *Attorney, Agent, or Firm*—Angus C. Fox, III

(57) ABSTRACT

The present invention includes several new embodiments of corner trim for use with vinyl or aluminum siding, which provide an appearance similar to that provided by the use of cast concrete corner stones at a fraction of the cost. The new corner trim is essentially a shell formed to have the appearance of a corner stone. Like the cast concrete stones it emulates, it is designed to fit over the corner of a structure. It may be manufactured from polymeric vinyl material via either injection molding or sheet forming process, or it may be formed by stamping sheet aluminum sheet. If aluminum is used, some welding may be required at the corners of the trim. A first embodiment of the corner trim incorporates a laminar, perimetric rim at the edges of the shell. When mounted on the building corner, the rim is perpendicular to the walls. A separate perimetric mounting strip is stapled to the wall sheathing on both sides of the building corner. The corner trim is then pressed into place on the corner, with the edges of the corner trim mating with the mounting strip. A plurality of barbs may be employed to secure the rim to the mounting strip. Alternatively, the corner trim may be adhesively bonded to the mounting strip. A preferred embodiment of the corner trim incorporates a perimetric groove having a width slightly greater than the thickness of the siding, and in which the ends and edges of the abutting siding pieces terminate to provide a finished look. A second embodiment of the corner trim does not employ a separate mounting, but rather incorporates a perimetric mounting strip that may be stapled directly to the wall sheathing.

14 Claims, 9 Drawing Sheets

DECORATIVE CORNER TRIM AND MOUNTING SYSTEM FOR SHEET SIDING USED ON WOOD AND STEEL FRAME STRUCTURES

BACKGROUND OF THE INVENTION

1. Field of the Invention

This invention relates generally to sheet siding components and, more particularly, to decorative corner trim which enhances the aesthetics and increases the perceived value of frame-constructed buildings which are covered with such siding.

2. History of the Prior Art

In 1833, only a year after the city of Chicago began to rise from the treeless glacial plain adjacent lake Michigan, a carpenter from Connecticut named Augustine Deodat Taylor was asked to build a large number of houses in that Illinois city. Taylor responded by building what had become known as balloon frame houses. The walls, ceilings and roofs of a balloon frame structure are constructed from interconnected scantling frames which are subsequently covered. Though Taylor is frequently credited with the invention of the balloon frame structure, it seems that the construction technique emerged over several decades as a popular hybrid of many diverse building methods. In the historic Mississippi River town of Ste. Genevieve, Mo., the French were constructing houses, which still stand, using building methods which were precursors of the balloon frame method. Typically, the French constructed houses with palisade walls-vertical wooden posts placed side by side on 16-inch centers, with a continuous plate nailed across the top. Apparently, the walls were built flat on the ground, then tilted up within trenches dug along the perimeter of the building.

Eventually, this palisade construction was modified so that the posts were nailed onto timber sills resting on stone or brick foundations. When standard-size lumber is substituted for the posts, the process is very close to the balloon construction method.

Light-weight, wood-frame houses have become the standard in this country. Because they are quite resistant to destruction in earthquake-prone regions, they are being adopted in faraway places, such as Japan, where killer earthquakes are common.

For nearly a century after its development, wood-frame construction relied almost exclusively on board siding-applied either vertically in board and bat style, or horizontally in an overlapping format—as an exterior wall covering. In later years, this has given way to stucco, masonry, plywood sheathing, and horizontally-overlapping siding. Masonry exterior wall coverings are, without doubt, the most expensive. Cedar board and bat exterior covering material is generally the next most expensive to install. Stucco (i.e., steel-mesh-reinforced concrete) is generally less expensive than cedar board and bat. Although plywood exterior sheathing provides an outer covering that is especially structurally sound and quite inexpensive, it requires periodic painting to maintain its appearance and structural integrity. Horizontally-overlapping siding made from aluminum and vinyl materials, though structurally inferior to stucco and plywood siding, require little, if any, maintenance. Consequently, siding is frequently used in combination with inexpensive plywood or waferboard sheathing. They are also relatively inexpensive. Because of relatively low material and installation costs, horizontally-overlapping siding is often used to cover the frame walls of low-cost tract housing. It is infrequently used on custom houses. During the past several decades, corner stone trim pieces, made of cast concrete, have been used with increasing frequency on up-scale homes and office buildings throughout the country. Though such corner trim pieces are typically used in combination with a brick exterior, they are also used in combination with a stucco, or reinforced concrete, exterior. In the latter case, the trim pieces may be formed, or cast, at the same time that the stucco is being applied, thereby being merely thickened regions of stucco. The thickened regions may then be painted a color different from the one used to paint the rest of the building, thereby providing the appearance of individual blocks. In an era where custom high-end homes are looking ever more lavish and ornate, vinyl siding, on account of its wide usage on low and moderate cost homes, is perceived by many home buyers as cheap and unattractive. The escalation in attractiveness of homes covered with vinyl siding has definitely not kept pace with that of expensive custom homes. Though one may say that this fact is a reflection of the reality that the top ten percent of wage-earning households have benefitted disproportionately from the business expansion of the 1990s, another reason is the lack of appearance-enhancing options available for vinyl siding installations.

What is needed are new types of trim for use with vinyl siding that will provide an appearance of enhanced cost and value, without significantly raising the cost of construction.

SUMMARY OF THE INVENTION

The present invention includes several new embodiments of corner trim which provide an appearance similar to that provided by the use of cast concrete corner stones at a fraction of the cost. When used as corner decoration on frame structures, concrete corner stones are cast such that each has either a 90-degree V horizontal cross section or an L-shaped horizontal cross section. This is essential, as the upright studs used to frame the exterior walls are either 2×4s or 2×6s. The nominal frame width for these two cases is 3½ inches or 5½ inches, respectively. By having a V-shaped or L-shaped horizontal cross section, use of the corner stones, which when mounted have the appearance of being rectangular solids, provides the illusion that the walls are at least 12 inches thick. When the concrete corner stones are applied to the corner of a building, they are generally affixed in one of two basic configurations. When cast "stones" of the 90-degree V type are used, the stones are usually stacked directly above one another, with brickwork or stucco inserted between adjacent pairs of stones. When L-type stones are used, they are generally stacked one on top of the other, but reversing each stone with respect to its subjacent neighbor. The latter stacking technique provides a hound's tooth effect when viewing each of the intersecting walls, which share the stacked corner stones, from an elevational view.

The new vinyl corner trim is essentially a shell formed to have the appearance of a corner stone. Like the L-shaped and V-shaped cast concrete stones it emulates, it is designed to fit over the corner of a structure. It may be formed via an injection molding or sheet forming process. A first embodiment of the corner trim incorporates a laminar, perimetric rim at the edges of the shell. When mounted on the building corner, the rim is perpendicular to the walls. A perimetric mounting strip is stapled to the wall sheathing on both sides of the building corner. The corner trim is then pressed into place on the corner, with the edges of the corner trim mating with the mounting strip. A plurality of barbs are employed to secure the rim to the mounting strip. Alternatively, the corner trim may be adhesively bonded to the mounting strip. The mounting strip may include a bracing web, which maintains accurate spacing and configuration of the mounting strip. The perimetric mounting strip may incorporate a groove into which the laminar perimetric rim of the corner trim is pressed. Alternatively, the mounting strip may incorporate a single perimetric wall which mates with the perimetric rim of the corner trim. The mounting strip may be designed so that the perimetric wall mates with either the inner or outer surface of the perimetric rim. A preferred embodiment of the corner trim incorporates a perimetric groove having a width slightly greater than the thickness of the siding, and in which the ends and edges of the abutting siding pieces terminate to provide a finished look.

A second embodiment of the corner trim does not employ a separate mounting, but rather incorporates a perimetric mounting strip that may be stapled directly to the wall sheathing.

DETAILED DISCLOSURE OF INVENTION

The present invention includes several new embodiments of vinyl corner trim which provide an appearance similar to that provided by the use of cast concrete corner stones at a fraction of the cost.

Figure 1:
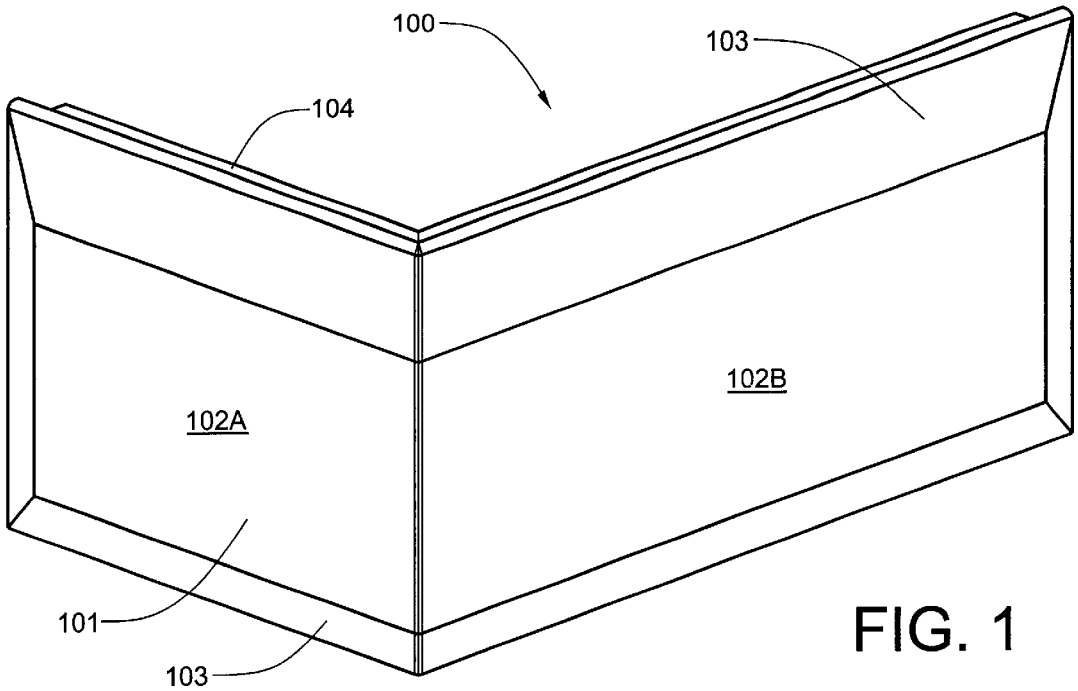
FIG. 1 is an isometric view of a first embodiment of the new vinyl corner trim piece.

Referring now to FIG. 1, an asymmetrical, L-shaped first embodiment of the new vinyl corner trim 100 incorporates a shell 101 having perpendicularly intersecting first and second rectangular face portions 102A and 102B, which respectively fit against the intersecting surfaces of a building corner. The shell is styled to have the appearance of a cast concrete corner stone. The shell also has a beveled, perimetric border 103. It may be formed via an injection molding or sheet forming process. The first embodiment corner trim incorporates a laminar, perimetric rim 104 near the edges of the shell. When mounted on the building corner, the rim 104 is perpendicular to the walls.

Figure 2:
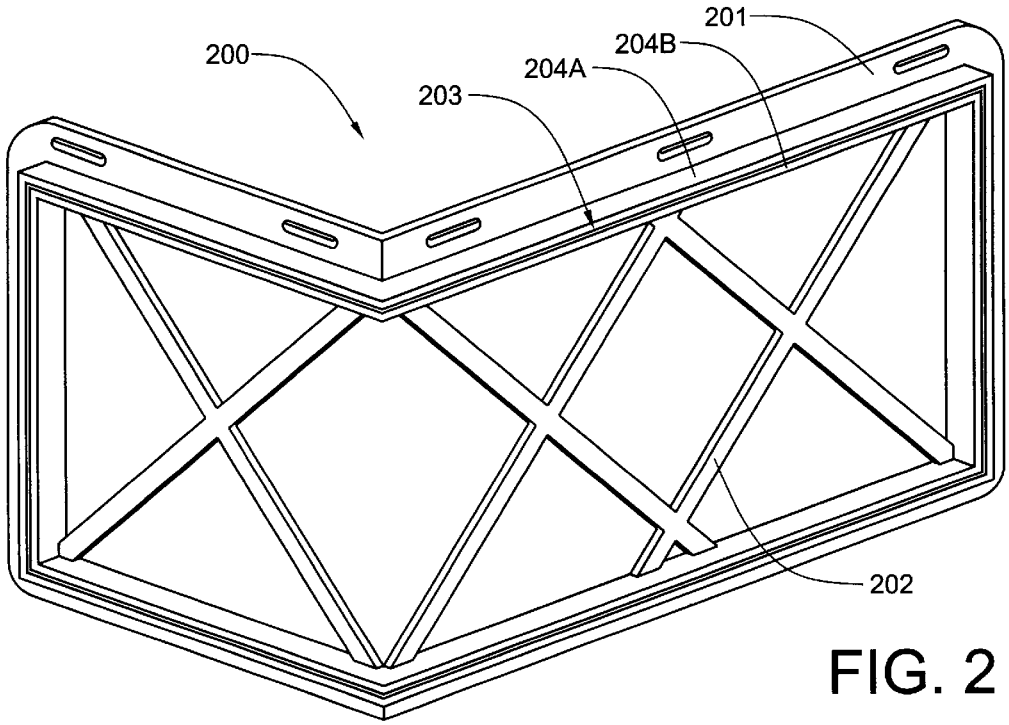
FIG. 2 is an isometric view of a first embodiment of a perimetric mounting strip.
Figure 3:
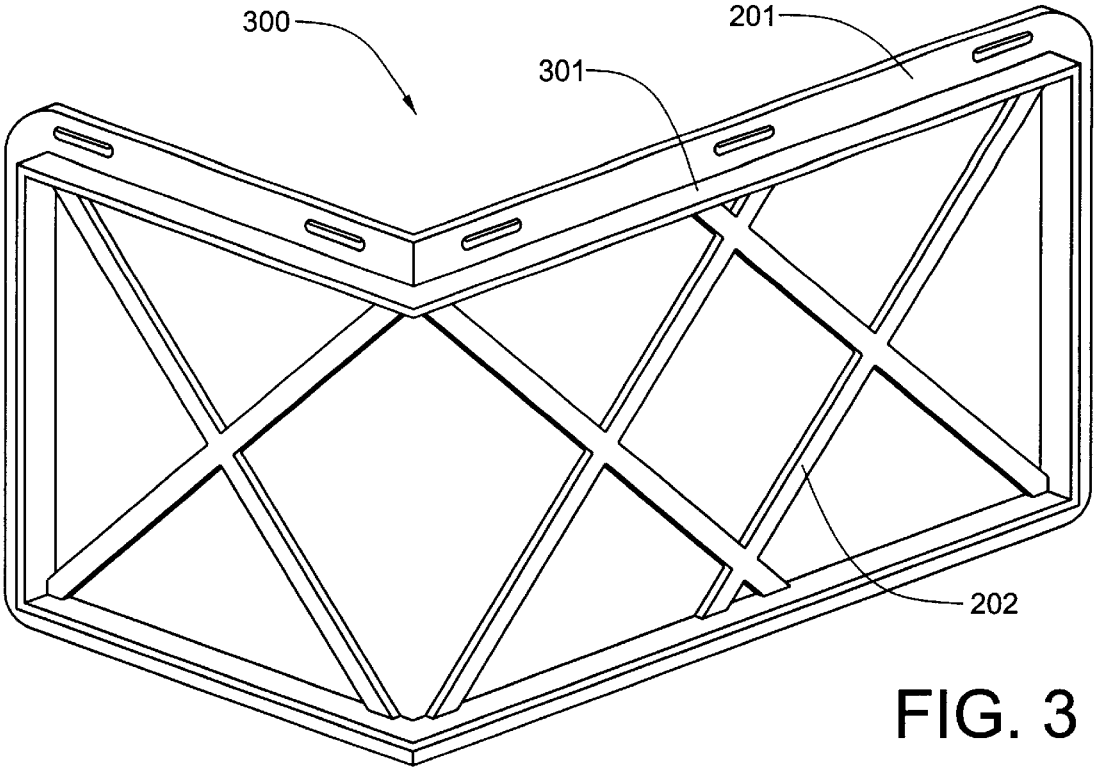
FIG. 3 is an isometric view of a second embodiment of a perimetric mounting strip.
Figure 4:
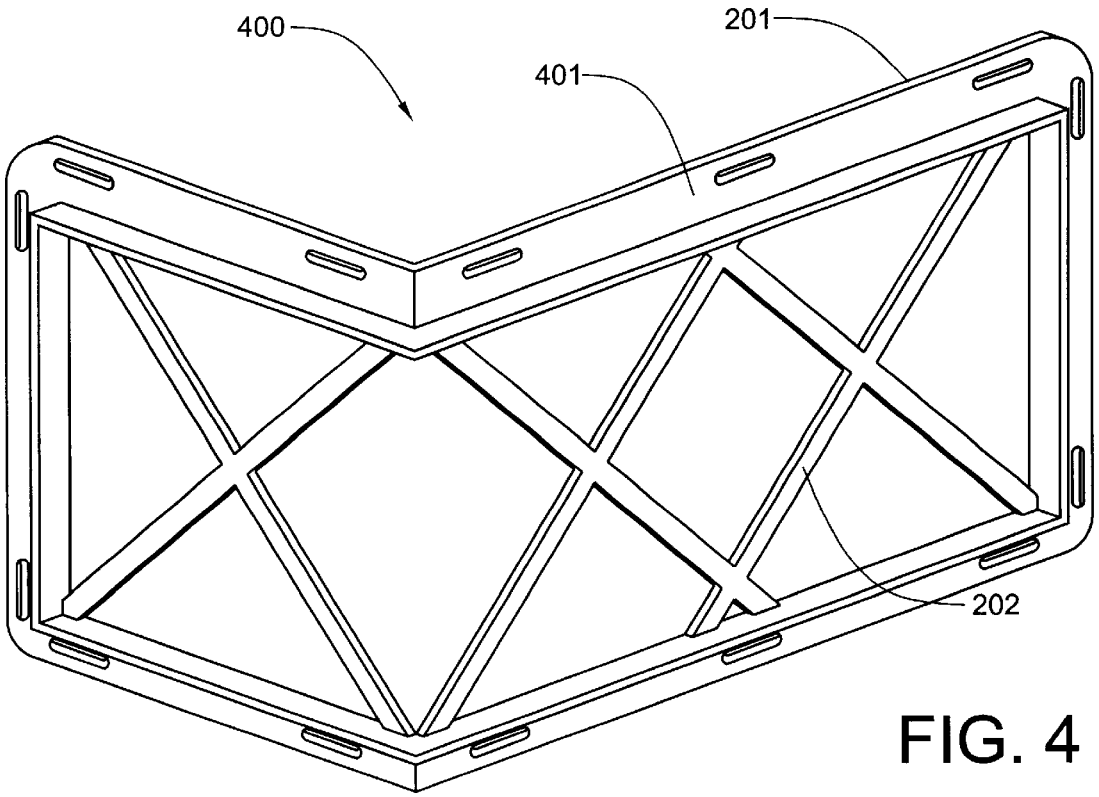
FIG. 4 is an isometric view of a third embodiment of a perimetric mounting strip.

Referring now to FIGS. 2, 3 and 4, the corner trim mounts to a perimetric mounting strip 200, 300 or 400. The mounting strip 200, 300 or 400 has a perimetric skirt 201 that is stapled to the wall sheathing on both sides of the building corner. The apertures in the skirt 201 facilitate the stapling process and indicate preferred staple locations. The corner trim 100 is then pressed into place on the corner, with the rim 104 of the corner trim 100 mating with the mounting strip 200, 300 or 400. A plurality of barbs are employed to secure the rim 104 to the mounting strip 200, 300 or 400. The mounting strip may include a bracing web 202, which maintains accurate spacing and configuration of the mounting strip as it is stapled to the sheathing. Three embodiments of the mounting strip are shown. The first embodiment thereof, 200, incorporates a perimetric groove 203 formed by two perimetric walls 204A and 204B, into which the laminar perimetric rim 104 of the corner trim 100 is pressed. The second embodiment mounting strip 300 incorporates a single perimetric wall 301, the inner surface of which mates with the outer surface of the perimetric rim 104 of the corner trim 100. The third embodiment mounting strip also incorporates a single perimetric wall 401, but the outer surface thereof mates with the inner surface of the perimetric rim 104 of the corner trim 100.

Figure 5:
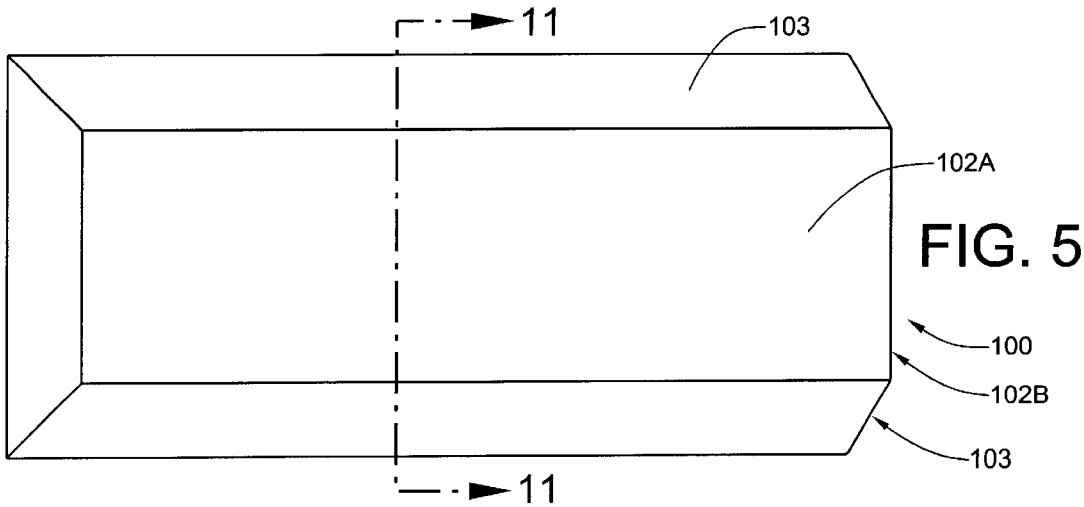
FIG. 5 is a front-side elevational view of the long side of the first embodiment of the corner trim piece.

Referring now to FIG. 5, a portion of the beveled border 103 on the longer face portion 102A of corner trim 100 is plainly visible in this view. A portion of the beveled border 103 on the shorter face portion 102B can also be seen in profile.

Figure 6:
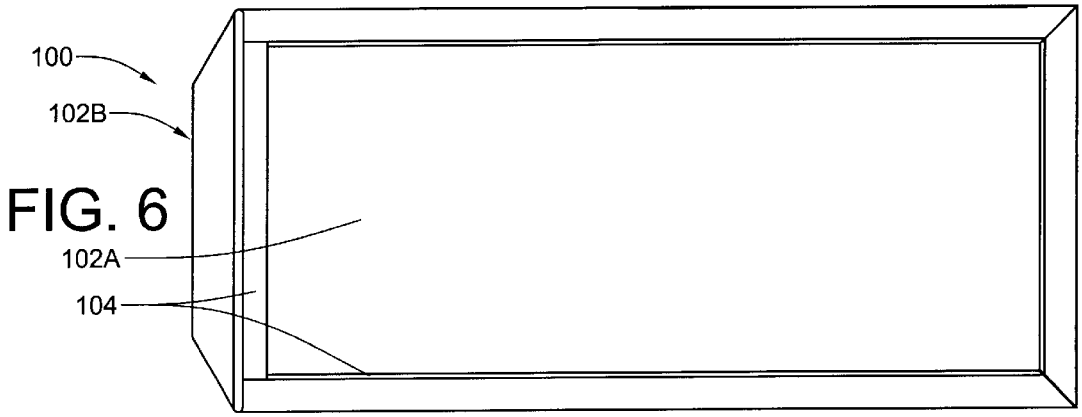
FIG. 6 is back-side elevational view of the long side of the first embodiment of the corner trim piece.

Referring now to FIG. 6, the inside of the corner trim 100 is shown. The edges of the perimetric rim 104 near the perimeter of the longer face portion 102A of corner trim 100 are visible, as is the side of perimetric rim 104 on the shorter face portion 102B of corner trim 100.

Figure 7:
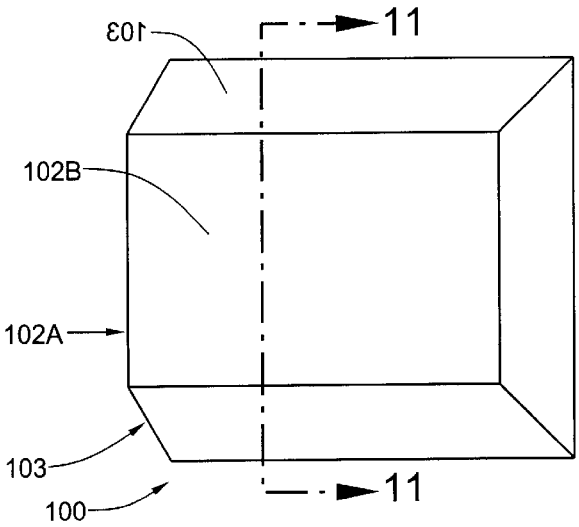
FIG. 7 is a front-side elevational view of the short side of the first embodiment of the corner trim piece.
Figure 8:
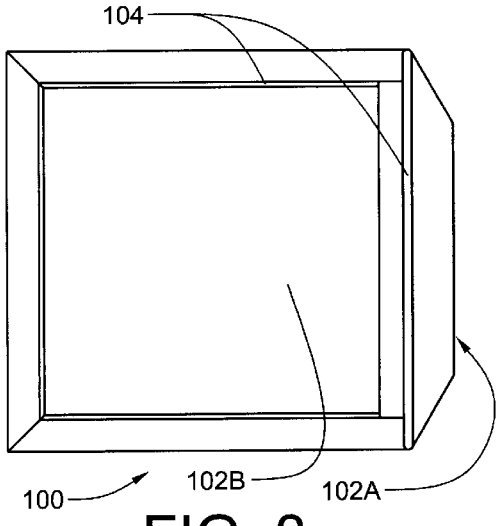
FIG. 8 is a back-side elevational view of the short side of the first embodiment of the corner trim piece.

The shorter side views of corner trim 100 depicted in FIGS. 7 and 8 show exterior and interior features, respectively, which are similar to those observable in FIGS. 5 and 6.

Figure 9:
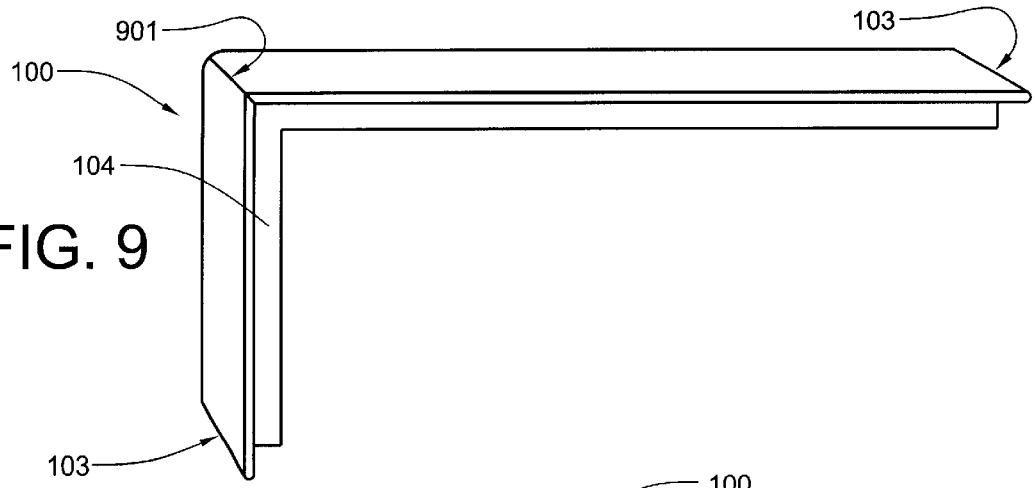
FIG. 9 is a top plan view of the first embodiment of the corner trim piece.

Referring now to FIG. 9, the perimetric rim 104 is visible for both the long and short sides of corner trim 100. The beveled border 103 is also visible in profile on both the long and short sides of corner trim 100. In the corner, a seam 901 is visible. The seam is required due to the necessity of removing sheet material in the corner region if the corner trim is fabricated from sheet material.

Figure 10:
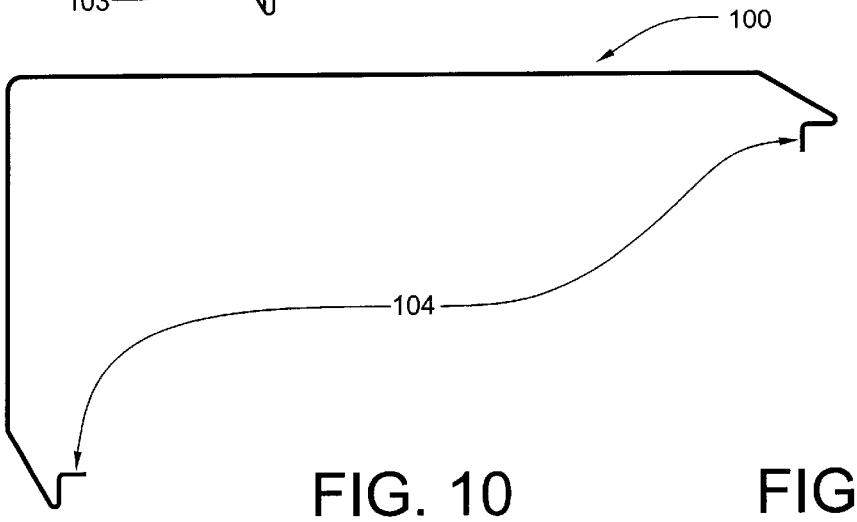
FIG. 10 is a thin slice profile view of the first embodiment trim piece taken through line 10—10 of FIG. 6.
Figure 11:
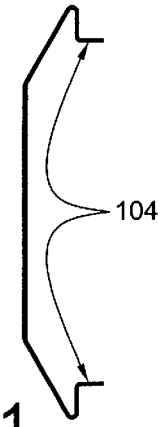
FIG. 11 is a thin slice profile view of the first embodiment trim piece taken through line 11—11 of FIG. 7.

Referring now to both FIG. 10 and FIG. 11, the thin-slice profile views enable the viewer to fully understand how the corner trim 100 may be formed from sheet plastic material. The perimetric rim 104 engages the groove or wall of the perimetric mounting strip 200, 300 or 400.

Figure 12:
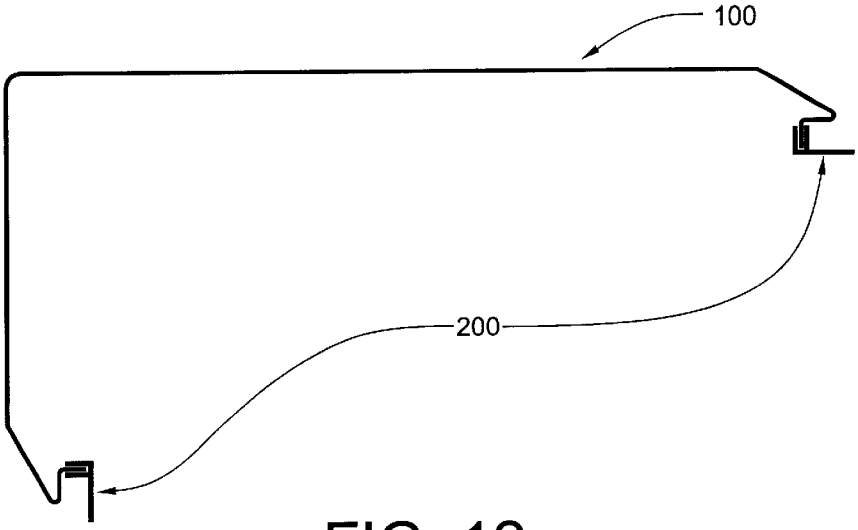
FIG. 12 is a thin slice profile view taken in the same region of the corner trim piece as that of FIG. 10, but with the mounting strip installed on the rim of the trim piece.
Figure 13:
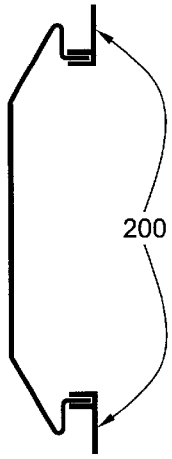
FIG. 13 is a thin slice profile view taken in the same region of the corner trim piece as that of FIG. 11, but the with the mounting strip installed on the rim of the trim piece.

Referring now to both FIG. 12 and FIG. 13, the thin-slice profile view through a corner trim 100 installed in a first embodiment perimetric mounting strip 200 shows how the rim 104 of the corner trim 100 engages the perimetric groove of the mounting strip 200.

Figure 14:
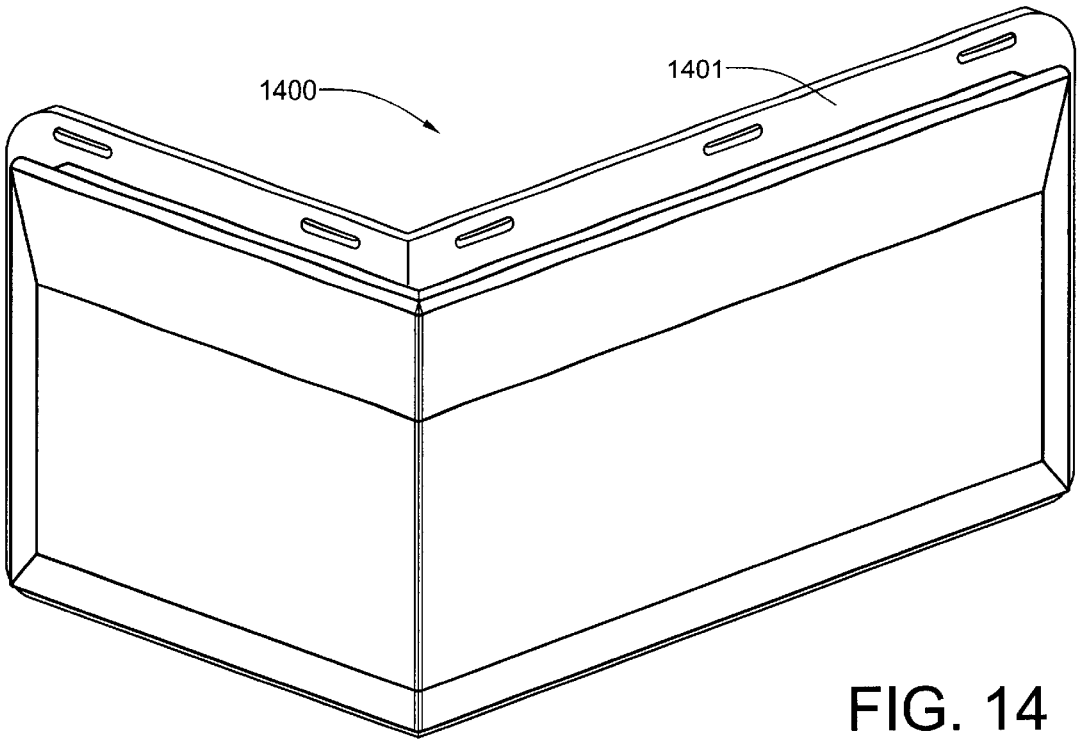
FIG. 14 is an isometric view of a second embodiment of the new corner trim piece.

Referring now to FIG. 14, an alternate embodiment of the corner trim 1400 incorporates a stapleable mounting strip 1401, thereby eliminating the need for a separate perimetric mounting strip such as 200, 300 or 400.

Figure 15:
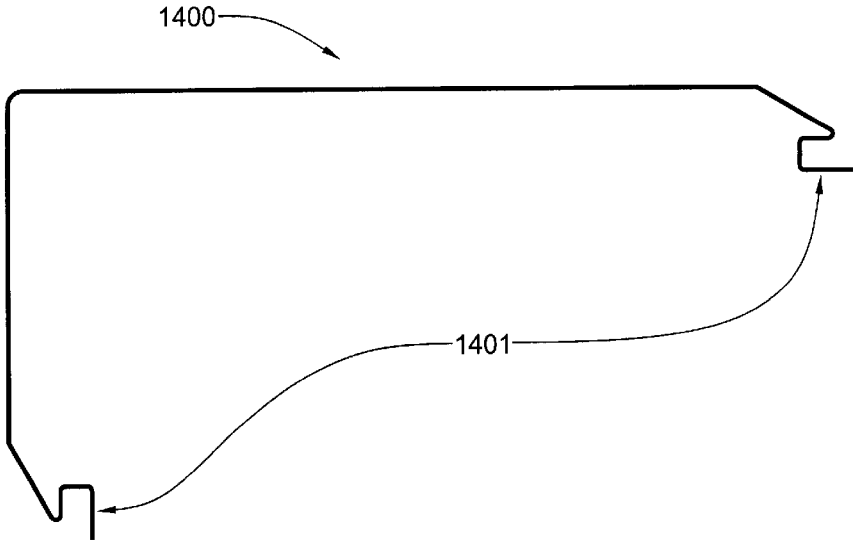
FIG. 15 is a thin slice profile view of the second embodiment corner trim piece, which is similar to that of FIG. 10, but with a built-in mounting strip.
Figure 16:
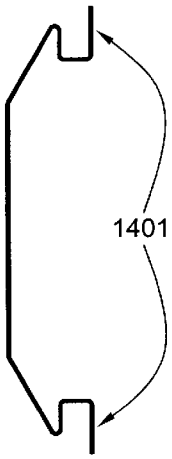
FIG. 16 is a thin slice profile view of the second embodiment corner trim piece, which is similar to that of FIG. 11, but with a built-in mounting strip.

FIGS. 15 and 16 show thin-slice profile views through the corner trim 1400 of FIG. 14. They are taken in the same locations as those of FIGS. 12 and 13.

Figure 17:
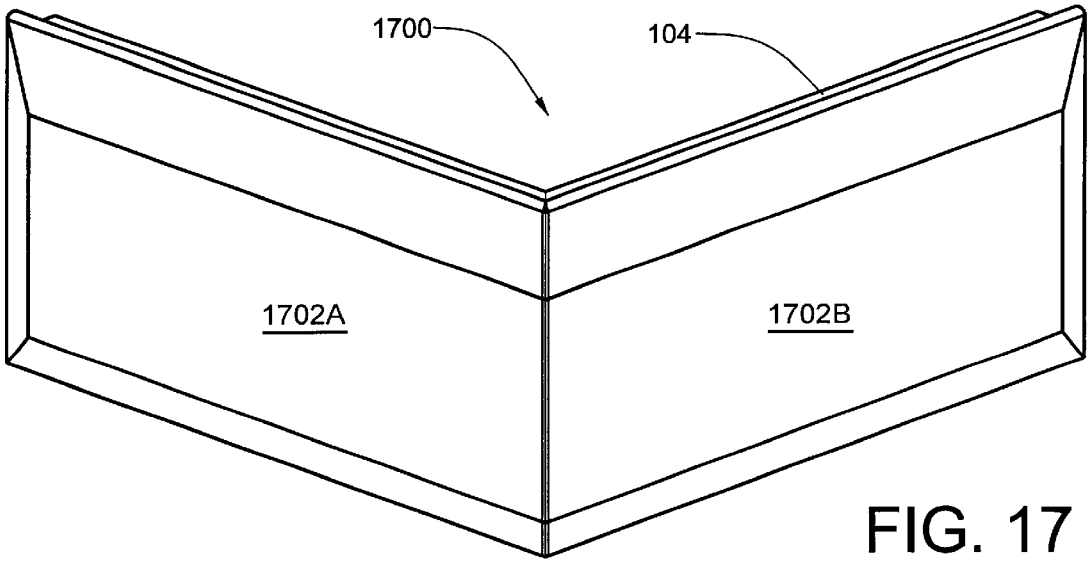
FIG. 17 is an isometric view of a third embodiment of the new corner trim piece.

Referring now to FIG. 17, a symmetrical, V-shaped corner trim 1700, having features similar to those of the embodiment of FIG. 1, is shown. The only significant difference between it and the corner trim 100 of FIG. 1 is the equal length of the face portions 1702A and 1702B on crner trim 1700, whereas the embodiment of FIG. 1 has long and short face portions 102A and 102B, respectively.

Figure 18:
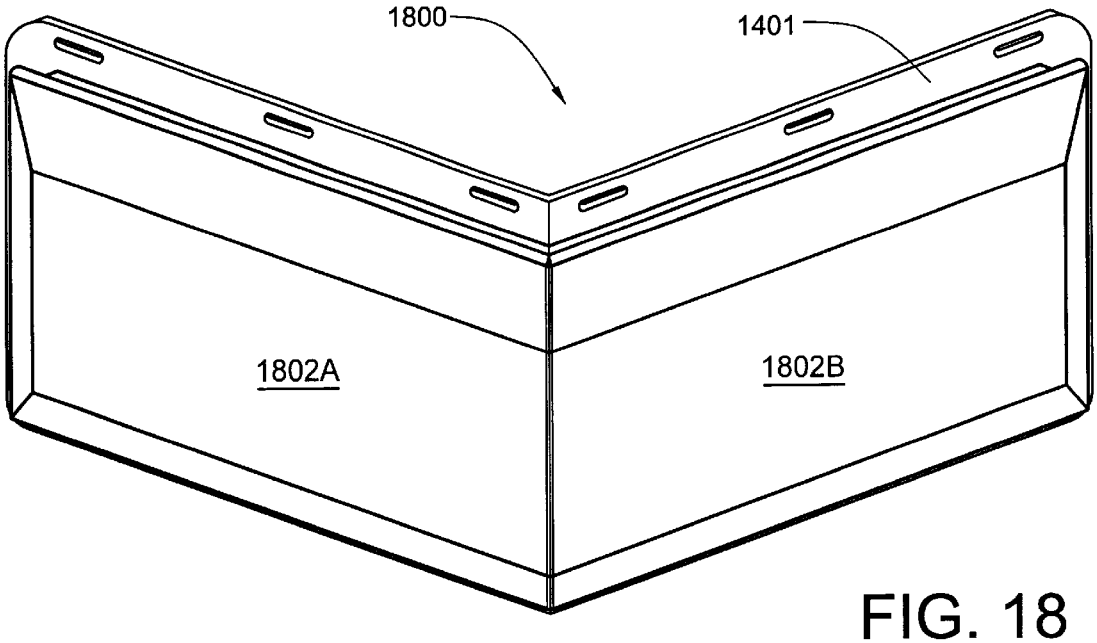
FIG. 18 is an isometric view of a fourth embodiment of the new corner trim piece.

Referring now to FIG. 18, a V-shaped corner trim 1800 incorporates a stapleable mounting strip 1401. The only significant difference between it and the corner trim embodiment shown in FIG. 14 is the equal length of the face portions 1802A and 1802B on corner trim 1800.

Figure 19:
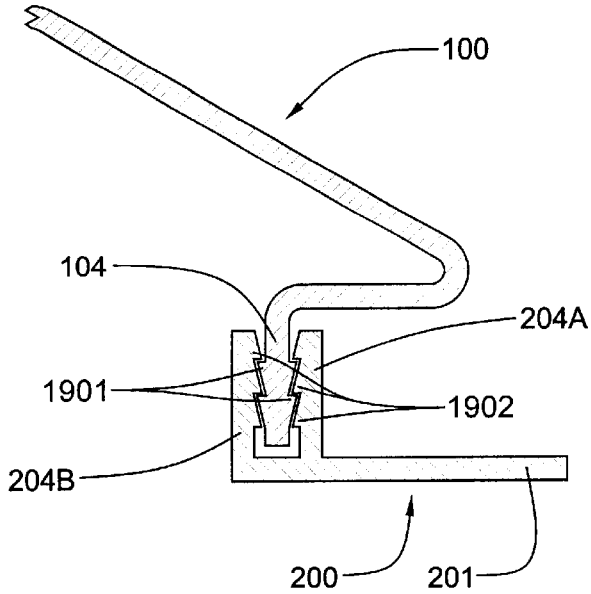
FIG. 19 is an enlarged, thin-slice profile view of the mating of the rim of the corner trim with a first embodiment mounting strip.

Referring now to FIG. 19, the enlarged profile view of the end portion of the trim piece 100 and mounting strip 200 of FIG. 10 shows a plurality of interlocking barbs. The trim piece rim 104 has a first set of barbs 1901, while the mounting strip 200 has a second set of barbs 1902, which interlock with those of the trim piece rim 104.

Figure 20:
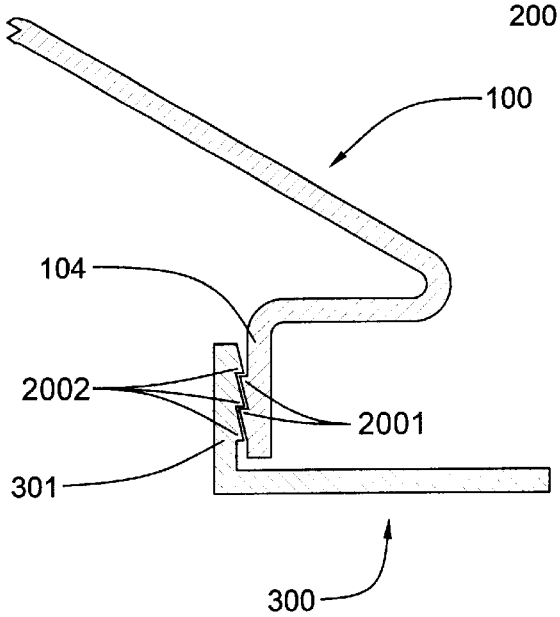
FIG. 20 is an enlarged, thin-slice profile view of the mating of the rim of the corner trim with a second embodiment mounting strip.

Referring now to FIG. 20, the enlarged profile view of the end portion of the trim piece 100 and mounting strip 300 shows a plurality of interlocking barbs. The trim piece rim 104 has a first set of barbs 2001, while the mounting strip 300 has a second set of barbs 2002, which interlock with those on the outer surface of the trim piece rim 104.

Figure 21:
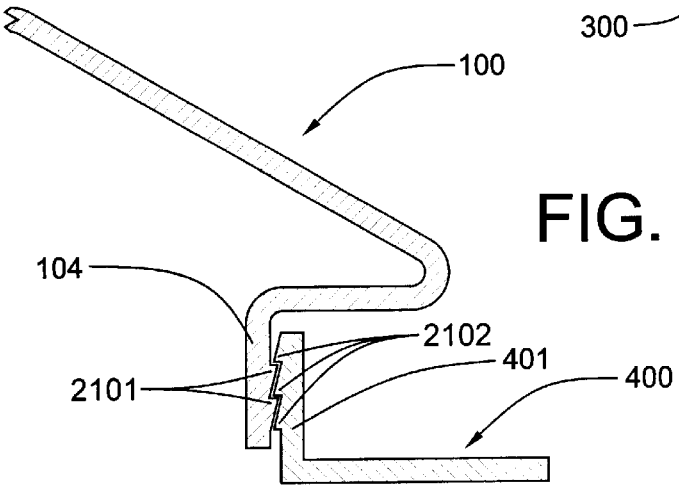
FIG. 21 is an enlarged, thin-slice profile view of the mating of the rim of the corner trim with a third embodiment mounting strip.

Referring now to FIG. 21, the enlarged profile view of the end portion of the trim piece 100 and mounting strip 400 shows a plurality of interlocking barbs. The trim piece rim 104 has a first set of barbs 2101, while the mounting strip 400 has a second set of barbs 2102, which interlock with those on the inner surface of the trim piece rim 104.

Figure 22:
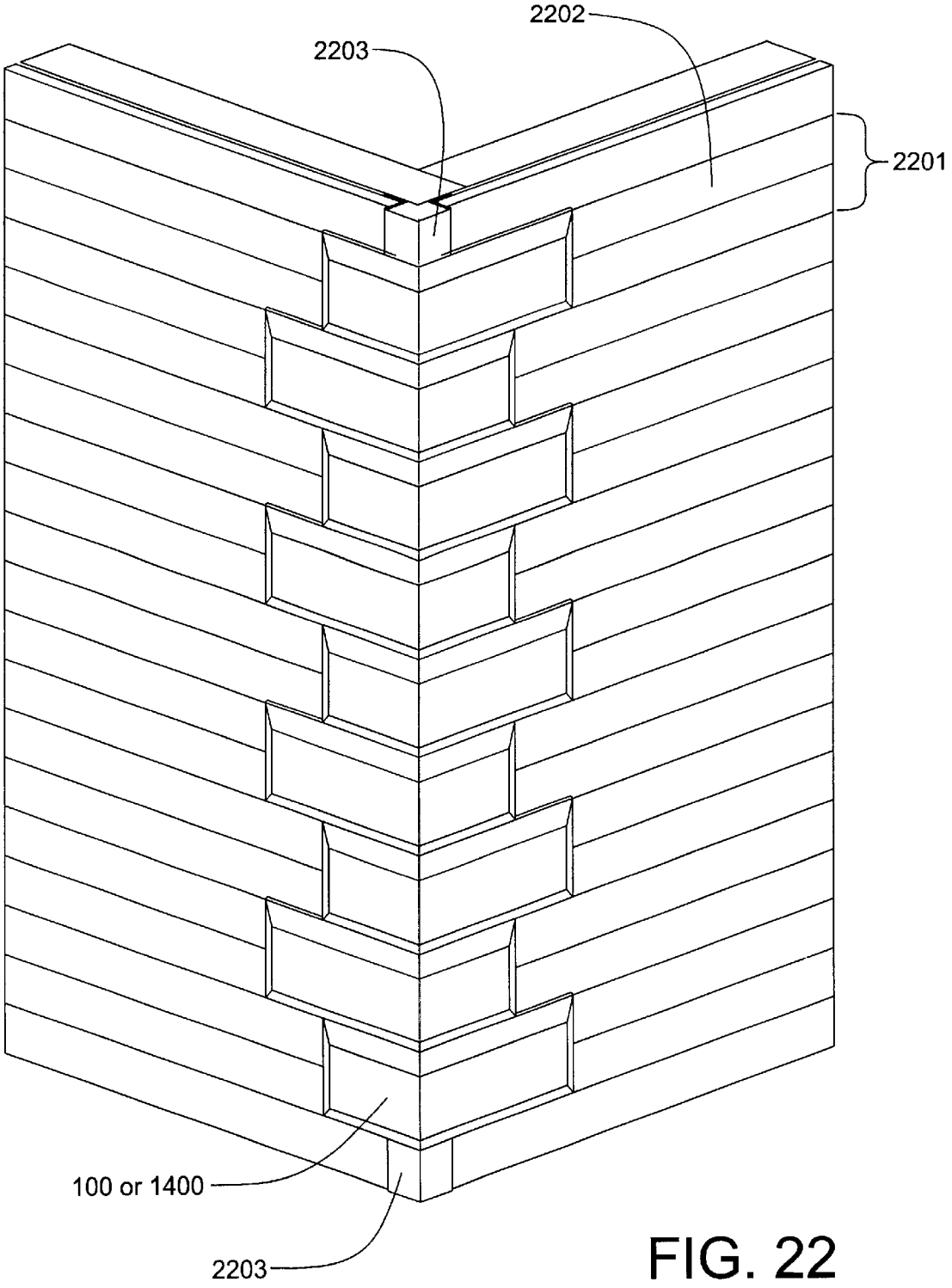
FIG. 22 is an isometric view of the corner of a building constructed from scantling frames having both siding and multiple asymmetrical corner trims attached thereto.
Figure 23:
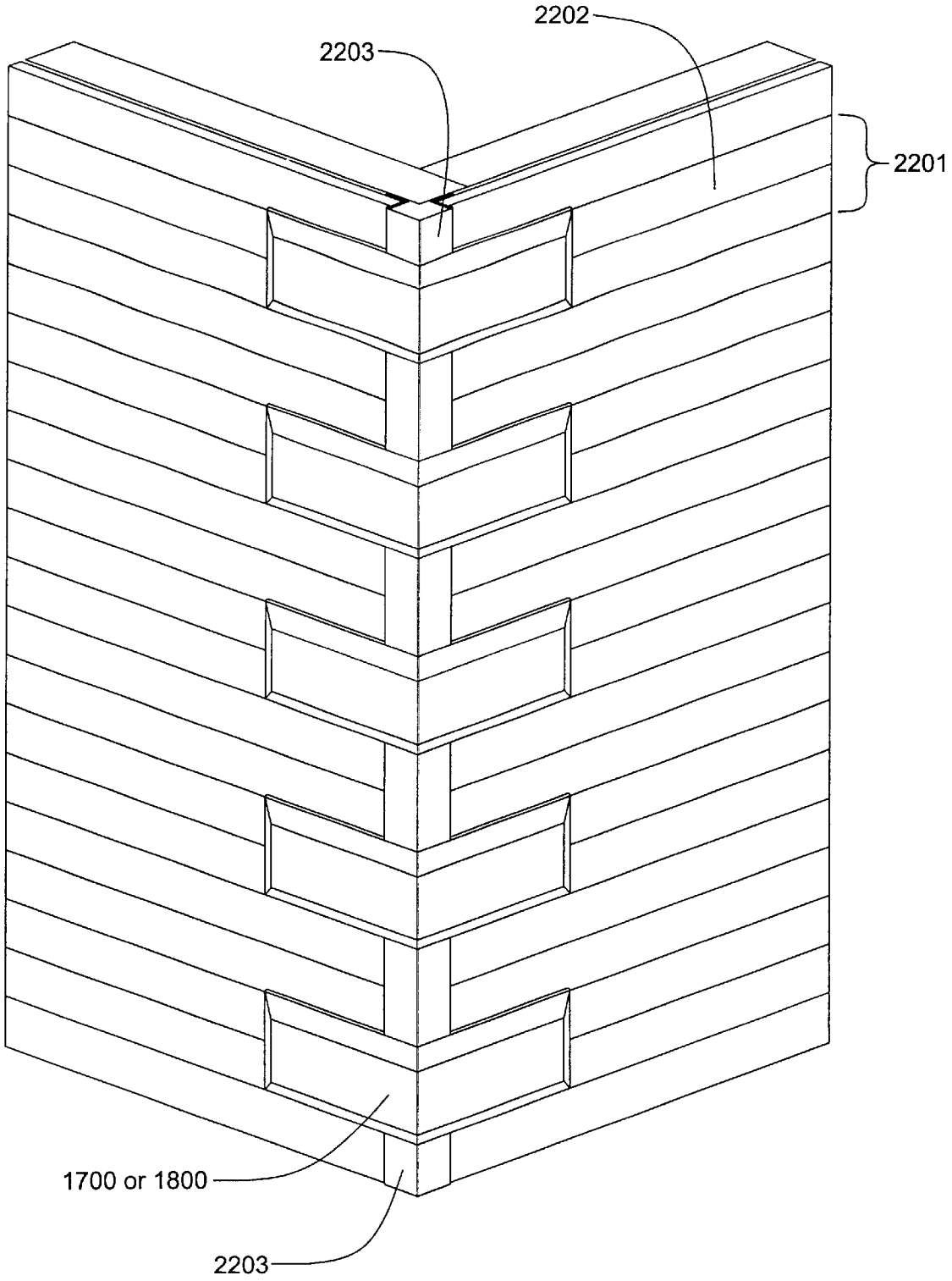
FIG. 23 is an isometric view of the corner of a building constructed from scantling frames having both siding and multiple symmetrical corner trims attached thereto.

Referring now to FIG. 22, nine asymmetrical corner trim pieces 100 or 1400 have been installed on the corner of a structure. On each side of the structure, 10 siding pieces 2201 are installed, each siding piece have the appearance of two horizontal slats 2202. It will be noted that two conventional corner strip pieces 2203 are installed at the top and bottom of the corner, thereby providing finished termination for two of the "slats" 2202. Each piece of siding is specially cut to fit the beneath the edges of the respective abutting corner trim piece 100 or 1400 or the conventional corner strip piece 2203 Referring now to FIG. 23, five symmetrical corner trim pieces 1700 or 1800 have been installed on the corner of a structure. Each corner trim piece 1700 or 1800 is vertically spaced apart from its adjacent neighbors. A conventional corner strip piece 2203 is installed at the top and bottom of the corner, as well as between each adjacent pair of corner trim pieces 1700 or 1800. Ten pieces of siding 2201 are installed on each side of the structure, each being specially cut to fit the beneath the edges of the respective abutting corner trim piece 1700 or 1800 or the conventional corner strip piece 2203

Although only several embodiments of the present invention have been disclosed herein, it will be obvious to those having ordinary skill in the art that changes and modifications may be made thereto without departing from the scope and spirit of the invention as hereinafter claimed.

What is claimed is:

1. A corner trim providing a decorative appearance to the corners of buildings constructed from scantling frames covered with wood-based sheathing, said appearance being similar to that provided by a cast concrete corner stone, said corner trim for use with siding applied as horizontal strips, said corner trim comprising:

a shell having, on its outer surface, the appearance of a cast concrete corner stone;

a perimetric rim at the outer edges of the shell; and a mounting strip stapleable directly to the sheathing, said perimetric rim attaching to said mounting strip.

2. The corner trim of claim 1, wherein the shell and the mounting strip are formed from a polymeric vinyl material.

3. The corner trim of claim 1, wherein the shell is formed from sheet aluminum and the mounting strip is formed from a polymeric vinyl material.

4. The corner trim of claim 1, wherein said perimetric rim incorporates at least one barbed edge, and said mounting strip incorporates at least one barbed edge, the barbed edge of the perimetric rim and the barbed edge of the mounting strip interlocking when the perimetric rim of the shell is attached to the mounting strip.

5. The crner trim of claim 1, wherein said perimetric rim is adapted for adhesive attachment to said mounting strip.

6. The crner trim of claim 1, wherein said shell is asymmetrical, thereby permitting multiple crner trim pieces to be stacked in a pattern of alternating asymmetry to form a hounds-tooth pattern.

7. The crner trim of claim 1, wherein said shell is symmetrical, thereby permitting multiple corner trim pieces to be stacked in a spaced-apart relationship, with siding pieces interposed between adjacent pairs of crner trim pieces.

8. A crner trim which provides a decorative appearance to the crners of buildings constructed from scantling frames covered with wood-based sheathing, said appearance being similar to that provided by a cast concrete crner stone, said crner trim for rise with vinyl siding applied as horizontal strips, said crner trim comprising:

a shell formed from polymeric vinyl material, said shell having, on its outer surface, the appearance of a cast concrete crner stone;

a perimetric groove formed around at least a portion of the perimeter of said shell, said groove sized to receive the ends and edges of abutting siding pieces, so as to provide a finished appearance;

a perimetric rim continuous with said perimetric groove; and a mounting strip stapleable directly to the sheathing, said perimetric rim attaching to said mounting strip.

9. The crner trim of claim 8, wherein said perimetric rim incorporates at least one barbed edge, and said mounting strip incorporates at least one barbed edge, the barbed edge of the perimetric rim and the barbed edge of the mounting strip interlocking when the perimetric rim of the shell is attached to the mounting strip.

10. The crner trim of claim 8, wherein said perimetric rim is adapted for adhesive attachment to said mounting strip.

11. The corner trim of claim wherein said shell is asymmetrical, thereby permitting multiple corner trim pieces to be stacked in a pattern of alternating asymmetry to form a hounds-tooth pattern.

12. The crner trim of claim 8, wherein said shell is symmetrical, thereby permitting multiple crner trim pieces to be stacked in a spaced-apart relationship, with siding pieces interposed between adjacent pairs of crner trim pieces.

13. A corner trim formed from polymeric vinyl material which provides a decorative appearance to the crners of buildings constructed from scantling frames covered with wood-based sheathing, said crner trim for use with vinyl siding applied as horizontal strips, said crner trim comprising:

a shell having perpendicularly intersecting first and second generally rectangular portions which respectively fit against the intersecting surfaces of a building crner;

a perimetric groove formed around at least a portion of the perimeter of said shell, said groove sized to receive the ends and edges of abutting siding pieces, so as to provide a finished appearance;

a perimetric rim continuous with said perimetric groove; and a mounting strip stapleable directly to the sheathing, said perimetric rim attaching to said mounting strip.

14. The crner trim of claim 13, wherein said perimetric rim incorporates at least one barbed edge, and said mounting strip incorporates at least one barbed edge, the barbed edge of the perimetric rim and the barbed edge of the mounting strip interlocking when the perimetric rim of the shell is attached to the mounting strip.

* * * * *